US006609776B2

(12) United States Patent
Ames et al.

(10) Patent No.: US 6,609,776 B2
(45) Date of Patent: Aug. 26, 2003

(54) INKJET PRINTING SYSTEM WITH INK-EFFICIENT FONT

(75) Inventors: Eric L. Ames, Boise, ID (US); Reece D. Theobald, Eagle, ID (US); Don Carroll, Seattle, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 109 days.

(21) Appl. No.: 09/864,611

(22) Filed: May 24, 2001

(65) Prior Publication Data

US 2002/0175964 A1 Nov. 28, 2002

(51) Int. Cl.[7] ..... B41J 2/01
(52) U.S. Cl. ..... 347/15
(58) Field of Search ..... 347/5, 9, 15, 43; 358/3.02, 3.06, 3.13, 3.16

(56) References Cited

U.S. PATENT DOCUMENTS

| | | | | |
|---|---|---|---|---|
| 5,574,832 A | | 11/1996 | Towery et al. | |
| 5,600,351 A | | 2/1997 | Holstun et al. | |
| 5,742,300 A | * | 4/1998 | Klassen | 347/9 |
| 6,209,984 B1 | * | 4/2001 | Kim | 347/37 |
| 6,296,343 B1 | | 10/2001 | Alfaro | |

* cited by examiner

*Primary Examiner*—Craig Hallacher

(57) ABSTRACT

A customized font based on fixed font cells having certain non-printable pixels along its perimeter, and formed by a pixel grid having a higher dpi horizontal resolution as compared to its vertical resolution. By preventing any marking dots on adjacent pixels in a given row, a minimal amount of ink drops can be used to print digitized characters, and higher throughput is obtained by using a printhead having a nozzle pitch which is the same as the vertical print resolution, and which has a swath width which allows a complete row of character cells to be printed in a single pass of the printhead across the media.

29 Claims, 19 Drawing Sheets

```
; N=0060  003Ch
x=12 y=12
01          . . . . . . . . . . . .
02          . . . . . . . . . . . .
03          . . . . . . . . . . . .
04          . . . . . . . . . . . .
05          . . . . . . . 0 . 0 . .
06          . . . . 0 . 0 . . . . .
07          . 0 . 0 . . . . . . . .
08          . . . . 0 . 0 . . . . .
09          . . . . . . . 0 . 0 . .
10          . . . . . . . . . . . .
11          . . . . . . . . . . . .
12          . . . . . . . . . . . .
```

114

```
; N=0061  003Dh
x=12 y=12
01          . . . . . . . . . . . .
02          . . . . . . . . . . . .
03          . . . . . . . . . . . .
04          . . . . . . . . . . . .
05          . . . . . . . . . . . .
06          . 0 . 0 . 0 . 0 . 0 . .
07          . . . . . . . . . . . .
08          . 0 . 0 . 0 . 0 . 0 . .
09          . . . . . . . . . . . .
10          . . . . . . . . . . . .
11          . . . . . . . . . . . .
12          . . . . . . . . . . . .
```

116

```
; N=0062  003Eh
x=12 y=12
01          . . . . . . . . . . . .
02          . . . . . . . . . . . .
03          . . . . . . . . . . . .
04          . . . . . . . . . . . .
05          . 0 . 0 . . . . . . . .
06          . . . . 0 . 0 . . . . .
07          . . . . . . . 0 . 0 . .
08          . . . . 0 . 0 . . . . .
09          . 0 . 0 . . . . . . . .
10          . . . . . . . . . . . .
11          . . . . . . . . . . . .
12          . . . . . . . . . . . .
```

```
; N=0063  003Fh
x=12 y=12
01          . . . . . . . . . . . .
02          . . . 0 . 0 . 0 . . . .
03          . 0 . . . . . . . 0 . .
04          . . . . . . . . . 0 . .
05          . . . . . . . . 0 . . .
06          . . . . . . 0 . . . . .
07          . . . . . 0 . . . . . .
08          . . . . . . . . . . . .
09          . . . . 0 . 0 . . . . .
10          . . . . 0 . 0 . . . . .
11          . . . . . . . . . . . .
12          . . . . . . . . . . . .
```

```
; N=0064  0040h
x=12 y=12
01          . . . . . . . . . . . .
02          . . . . . . . . . . . .
03          . . . . 0 . 0 . 0 . . .
04          . . 0 . . . . . . 0 . .
05          . 0 . . . 0 . 0 . 0 . .
06          . 0 . . 0 . . . . 0 . .
07          . 0 . . 0 . . . . 0 . .
08          . 0 . . . 0 . 0 . 0 . .
09          . . 0 . . . . . . . . .
10          . . . . 0 . 0 . 0 . . .
11          . . . . . . . . . . . .
12          . . . . . . . . . . . .
```

FIG. 4a

```
; N=0065  0041H
x=12  y=12
01          . . . . . . . . . . . .
02          . . . . . 0 . . . . . .
03          . . . 0 . . . 0 . . . .
04          . 0 . . . . . . . 0 . .
05          . 0 . . . . . . . 0 . .
06          . 0 . 0 . 0 . 0 . 0 . .
07          . 0 . . . . . . . 0 . .
08          . 0 . . . . . . . 0 . .
09          . 0 . . . . . . . 0 . .
10          . 0 . . . . . . . 0 . .
11          . . . . . . . . . . . .
12          . . . . . . . . . . . .
```

112

110

```
; N=0066  0042H
x=12  y=12
01          . . . . . . . . . . . .
02          . 0 . 0 . 0 . 0 . . . .
03          . 0 . . . . . . . 0 . .
04          . 0 . . . . . . . 0 . .
05          . 0 . . . . . . . 0 . .
06          . 0 . 0 . 0 . 0 . . . .
07          . 0 . . . . . . . 0 . .
08          . 0 . . . . . . . 0 . .
09          . 0 . . . . . . . 0 . .
10          . 0 . 0 . 0 . 0 . . . .
11          . . . . . . . . . . . .
12          . . . . . . . . . . . .
```

```
; N=0067  0043H
x=12  y=12
01          . . . . . . . . . . . .
02          . . . 0 . 0 . 0 . . . .
03          . 0 . . . . . . . 0 . .
04          . 0 . . . . . . . . . .
05          . 0 . . . . . . . . . .
06          . 0 . . . . . . . . . .
07          . 0 . . . . . . . . . .
08          . 0 . . . . . . . . . .
09          . 0 . . . . . . . 0 . .
10          . . . 0 . 0 . 0 . . . .
11          . . . . . . . . . . . .
12          . . . . . . . . . . . .
```

122

118

```
; N=0068  0044H
x=12  y=12
01          . . . . . . . . . . . .
02          . 0 . 0 . 0 . 0 . . . .
03          . 0 . . . . . . . 0 . .
04          . 0 . . . . . . . 0 . .
05          . 0 . . . . . . . 0 . .
06          . 0 . . . . . . . 0 . .
07          . 0 . . . . . . . 0 . .
08          . 0 . . . . . . . 0 . .
09          . 0 . . . . . . . 0 . .
10          . 0 . 0 . 0 . 0 . . . .
11          . . . . . . . . . . . .
12          . . . . . . . . . . . .
```

```
; N=0069  0045H
x=12  y=12
01          . . . . . . . . . . . .
02          . 0 . 0 . 0 . 0 . 0 . .
03          . 0 . . . . . . . . . .
04          . 0 . . . . . . . . . .
05          . 0 . . . . . . . . . .
06          . 0 . 0 . 0 . 0 . . . .
07          . 0 . . . . . . . . . .
08          . 0 . . . . . . . . . .
09          . 0 . . . . . . . . . .
10          . 0 . 0 . 0 . 0 . 0 . .
11          . . . . . . . . . . . .
12          . . . . . . . . . . . .
```

```
; N=0070  0046H
x=12  y=12
01          . . . . . . . . . . . .
02          . 0 . 0 . 0 . 0 . 0 . .
03          . 0 . . . . . . . . . .
04          . 0 . . . . . . . . . .
05          . 0 . . . . . . . . . .
06          . 0 . 0 . 0 . 0 . . . .
07          . 0 . . . . . . . . . .
08          . 0 . . . . . . . . . .
09          . 0 . . . . . . . . . .
10          . 0 . . . . . . . . . .
11          . . . . . . . . . . . .
12          . . . . . . . . . . . .
```

FIG. 4b

```
; N=0070  0046H
x=12  y=12
01          . . . . . . . . . . . .
02          . 0 . 0 . 0 . 0 . 0 . .
03          . 0 . . . . . . . . . .
04          . 0 . . . . . . . . . .
05          . 0 . . . . . . . . . .
06          . 0 . 0 . 0 . 0 . . . .
07          . 0 . . . . . . . . . .
08          . 0 . . . . . . . . . .
09          . 0 . . . . . . . . . .
10          . 0 . . . . . . . . . .
11          . . . . . . . . . . . .
12          . . . . . . . . . . . .
; N=0071  0047H
x=12  y=12
01          . . . . . . . . . . . .
02          . . . 0 . 0 . 0 . . . .
03          . 0 . . . . . . . 0 . .
04          . 0 . . . . . . . . . .
05          . 0 . . . . . . . . . .
06          . 0 . . . . . 0 . 0 . .
07          . 0 . . . . . . . 0 . .
08          . 0 . . . . . . . 0 . .
09          . 0 . . . . . . . 0 . .
10          . . . 0 . 0 . 0 . 0 . .
11          . . . . . . . . . . . .
12          . . . . . . . . . . . .
; N=0072  0048H                 124
x=12  y=12      120
01          . . . . . . . . . . . .
02          . 0 . . . . . . . 0 . .
03          . 0 . . . . . . . 0 . .
04          . 0 . . . . . . . 0 . .
05          . 0 . . . . . . . 0 . .
06          . 0 . 0 . 0 . 0 . 0 . .
07          . 0 . . . . . . . 0 . .
08          . 0 . . . . . . . 0 . .
09          . 0 . . . . . . . 0 . .
10          . 0 . . . . . . . 0 . .
11          . . . . . . . . . . . .
12          . . . . . . . . . . . .
; N=0073  0049H
x=12  y=12
01          . . . . . . . . . . . .
02          . . . 0 . 0 . 0 . . . .
03          . . . . . 0 . . . . . .
04          . . . . . 0 . . . . . .
05          . . . . . 0 . . . . . .
06          . . . . . 0 . . . . . .
07          . . . . . 0 . . . . . .
08          . . . . . 0 . . . . . .
09          . . . . . 0 . . . . . .
10          . . . 0 . 0 . 0 . . . .
11          . . . . . . . . . . . .
12          . . . . . . . . . . . .
; N=0074  004AH
x=12  y=12
01          . . . . . . . . . . . .
02          . . . . . . . 0 . 0 . .
03          . . . . . . . . . 0 . .
04          . . . . . . . . . 0 . .
05          . . . . . . . . . 0 . .
06          . . . . . . . . . 0 . .
07          . . . . . . . . . 0 . .
08          . 0 . . . . . . . 0 . .
09          . 0 . . . . . . . 0 . .
10          . . . 0 . 0 . 0 . . . .
11          . . . . . . . . . . . .
12          . . . . . . . . . . . .
; N=0075  004BH
x=12  y=12
01          . . . . . . . . . . . .
02          . 0 . . . . . . . 0 . .
03          . 0 . . . . . 0 . . . .
04          . 0 . . . 0 . . . . . .
05          . 0 . 0 . . . . . . . .
06          . 0 . . . 0 . . . . . .
07          . 0 . . . . 0 . . . . .
08          . 0 . . . . . 0 . . . .
09          . 0 . . . . . . 0 . . .
10          . 0 . . . . . . . 0 . .
11          . . . . . . . . . . . .
12          . . . . . . . . . . . .
```

FIG. 4c

```
; N=0077  004DH
x=12 y=12
01          . . . . . . . . . . . .
02          . . 0 . . . . . 0 . . .
03          . 0 . 0 . . . 0 . 0 . .
04          . 0 . . 0 . 0 . . 0 . .
05          . 0 . . 0 . 0 . . 0 . .
06          . 0 . . . 0 . . . 0 . .
07          . 0 . . . . . . . 0 . .
08          . 0 . . . . . . . 0 . .
09          . 0 . . . . . . . 0 . .
10          . 0 . . . . . . . 0 . .
11          . . . . . . . . . . . .
12          . . . . . . . . . . . .
; N=0078  004EH
x=12 y=12
01          . . . . . . . . . . . .
02          . 0 . . . . . . . 0 . .
03          . 0 . . . . . . . 0 . .
04          . 0 . 0 . . . . . 0 . .
05          . 0 . . 0 . . . . 0 . .
06          . 0 . . . 0 . . . 0 . .
07          . 0 . . . . 0 . . 0 . .
08          . 0 . . . . . 0 . 0 . .
09          . 0 . . . . . . . 0 . .
10          . 0 . . . . . . . 0 . .
11          . . . . . . . . . . . .
12          . . . . . . . . . . . .
; N=0079  004FH
x=12 y=12
01          . . . . . . . . . . . .
02          . . . 0 . 0 . 0 . . . .
03          . 0 . . . . . . . 0 . .
04          . 0 . . . . . . . 0 . .
05          . 0 . . . . . . . 0 . .
06          . 0 . . . . . . . 0 . .
07          . 0 . . . . . . . 0 . .
08          . 0 . . . . . . . 0 . .
09          . 0 . . . . . . . 0 . .
10          . . . 0 . 0 . 0 . . . .
11          . . . . . . . . . . . .
12          . . . . . . . . . . . .
```

FIG. 4d

```
; N=0100  0064H
x=12  y=12
01          . . . . . . . . . . . .
02          . . . . . . . . . 0 . .
03          . . . . . . . . . 0 . .
04          . . . . . . . . . 0 . .
05          . . . 0 . 0 . 0 . 0 . .
06          . . 0 . . . . . . 0 . .
07          . . 0 . . . . . . 0 . .
08          . . 0 . . . . . . 0 . .
09          . . 0 . . . . . . 0 . .
10          . . . 0 . 0 . 0 . 0 . .
11          . . . . . . . . . . . .
12          . . . . . . . . . . . .
```

114

```
; N=0101  0065H
x=12  y=12
01          . . . . . . . . . . . .
02          . . . . . . . . . . . .
03          . . . . . . . . . . . .
04          . . . . . . . . . . . .
05          . . . . 0 . 0 . 0 . . .
06          . . 0 . . . . . . 0 . .
07          . . 0 . . 0 . 0 . 0 . .
08          . . 0 . . . . . . . . .
09          . . 0 . . . . . . . . .
10          . . . . 0 . 0 . 0 . . .
11          . . . . . . . . . . . .
12          . . . . . . . . . . . .
```

116

112

```
; N=0102  0066H
x=12  y=12
01          . . . . . . . . . . . .
02          . . . . . . 0 . 0 . . .
03          . . . . . 0 . . . . . .
04          . . . . . 0 . . . . . .
05          . . 0 . 0 . 0 . 0 . . .
06          . . . . . 0 . . . . . .
07          . . . . . 0 . . . . . .
08          . . . . . 0 . . . . . .
09          . . . . . 0 . . . . . .
10          . . . . . 0 . . . . . .
11          . . . . . . . . . . . .
12          . . . . . . . . . . . .
```

110

```
; N=0103  0067H
x=12  y=12
01          . . . . . . . . . . . .
02          . . . . . . . . . . . .
03          . . . . . . . . . . . .
04          . . . . . . . . . . . .
05          . . . 0 . 0 . 0 . 0 . .
06          . . 0 . . . . . . 0 . .
07          . . 0 . . . . . . 0 . .
08          . . 0 . . . . . . 0 . .
09          . . 0 . . . . . . 0 . .
10          . . . 0 . 0 . 0 . 0 . .
11          . . . . . . . . . 0 . .
12          . . . 0 . 0 . 0 . . . .
```

128

```
; N=0104  0068H
x=12  y=12
01          . . . . . . . . . . . .
02          . . 0 . . . . . . . . .
03          . . 0 . . . . . . . . .
04          . . 0 . . . . . . . . .
05          . . 0 . 0 . 0 . 0 . . .
06          . . 0 . . . . . . 0 . .
07          . . 0 . . . . . . 0 . .
08          . . 0 . . . . . . 0 . .
09          . . 0 . . . . . . 0 . .
10          . . 0 . . . . . . 0 . .
11          . . . . . . . . . . . .
12          . . . . . . . . . . . .
```

```
; N=0105  0069H
x=12  y=12
01          . . . . . . . . . . . .
02          . . . . . . . . . . . .
03          . . . . . 0 . 0 . . . .
04          . . . . . . . . . . . .
05          . . 0 . 0 . 0 . . . . .
06          . . . . . . 0 . . . . .
07          . . . . . . 0 . . . . .
08          . . . . . . 0 . . . . .
09          . . . . . . 0 . . . . .
10          . . . . . . 0 . . . . .
11          . . . . . . . . . . . .
12          . . . . . . . . . . . .
```

FIG. 5a

```
; N=0106  006AH
x=12 y=12
01          . . . . . . . . . . . .
02          . . . . . . . . . . . .
03          . . . . . . 0 . 0 . . .
04          . . . . . . . . . . . .
05          . . . 0 . 0 . 0 . . . .
06          . . . . . . . 0 . . . .
07          . . . . . . . 0 . . . .
08          . . . . . . . 0 . . . .
09          . . . . . . . 0 . . . .
10          . . . . . . . 0 . . . .
11          . 0 . . . . . 0 . . . .
12          . . 0 . 0 . 0 . . . . .
; N=0107  006BH
x=12 y=12
01          . . . . . . . . . . . .
02          . . 0 . . . . . . . . .
03          . . 0 . . . . . . . . .
04          . . 0 . . . . 0 . . . .
05          . . 0 . . 0 . . . . . .
06          . . 0 . 0 . . . . . . .
07          . . 0 . . 0 . . . . . .
08          . . 0 . . . 0 . . . . .
09          . . 0 . . . . 0 . . . .
10          . . 0 . . . . . 0 . . .
11          . . . . . . . . . . . .
12          . . . . . . . . . . . .
; N=0108  006CH
x=12 y=12
01          . . . . . . . . . . . .
02          . . . . . . . . . . . .
03          . . . 0 . 0 . . . . . .
04          . . . . . 0 . . . . . .
05          . . . . . 0 . . . . . .
06          . . . . . 0 . . . . . .
07          . . . . . 0 . . . . . .
08          . . . . . 0 . . . . . .
09          . . . . . 0 . . . . . .
10          . . . . . 0 . . . . . .
11          . . . . . . . . . . . .
12          . . . . . . . . . . . .
```

128

```
; N=0109  006DH
x=12 y=12
01          . . . . . . . . . . . .
02          . . . . . . . . . . . .
03          . . . . . . . . . . . .
04          . . . . . . . . . . . .
05          . 0 . . 0 . 0 . 0 . . .
06          . 0 . . . 0 . . . 0 . .
07          . 0 . . . 0 . . . 0 . .
08          . 0 . . . 0 . . . 0 . .
09          . 0 . . . 0 . . . 0 . .
10          . 0 . . . 0 . . . 0 . .
11          . . . . . . . . . . . .
12          . . . . . . . . . . . .
; N=0110  006EH
x=12 y=12
01          . . . . . . . . . . . .
02          . . . . . . . . . . . .
03          . . . . . . . . . . . .
04          . . . . . . . . . . . .
05          . . 0 . . 0 . 0 . . . .
06          . . 0 . . . . . . 0 . .
07          . . 0 . . . . . . 0 . .
08          . . 0 . . . . . . 0 . .
09          . . 0 . . . . . . 0 . .
10          . . 0 . . . . . . 0 . .
11          . . . . . . . . . . . .
12          . . . . . . . . . . . .
; N=0111  006FH
x=12 y=12
01          . . . . . . . . . . . .
02          . . . . . . . . . . . .
03          . . . . . . . . . . . .
04          . . . . . . . . . . . .
05          . . . 0 . 0 . 0 . . . .
06          . 0 . . . . . . . 0 . .
07          . 0 . . . . . . . 0 . .
08          . 0 . . . . . . . 0 . .
09          . 0 . . . . . . . 0 . .
10          . . . 0 . 0 . 0 . . . .
11          . . . . . . . . . . . .
12          . . . . . . . . . . . .
```

FIG. 5b

```
; N=0112  0070H
x=12  y=12
01          . . . . . . . . . . . .
02          . . . . . . . . . . . .
03          . . . . . . . . . . . .
04          . . . . . . . . . . . .
05          . . 0 . 0 . 0 . 0 . . .
06          . . 0 . . . . . . 0 . .
07          . . 0 . . . . . . 0 . .
08          . . 0 . . . . . . 0 . .
09          . . 0 . . . . . . 0 . .
10          . . 0 . 0 . 0 . 0 . . .
11          . . 0 . . . . . . . . .
12          . . 0 . . . . . . . . .
```

128

```
; N=0113  0071H
x=12  y=12
01          . . . . . . . . . . . .
02          . . . . . . . . . . . .
03          . . . . . . . . . . . .
04          . . . . . . . . . . . .
05          . . . 0 . 0 . 0 . 0 . .
06          . . 0 . . . . . . 0 . .
07          . . 0 . . . . . . 0 . .
08          . . 0 . . . . . . 0 . .
09          . . 0 . . . . . . 0 . .
10          . . . 0 . 0 . 0 . 0 . .
11          . . . . . . . . . 0 . .
12          . . . . . . . . . 0 . .
```

```
; N=0114  0072H
x=12  y=12
01          . . . . . . . . . . . .
02          . . . . . . . . . . . .
03          . . . . . . . . . . . .
04          . . . . . . . . . . . .
05          . . 0 . 0 . 0 . 0 . . .
06          . . 0 . . . . . . 0 . .
07          . . 0 . . . . . . . . .
08          . . 0 . . . . . . . . .
09          . . 0 . . . . . . . . .
10          . . 0 . . . . . . . . .
11          . . . . . . . . . . . .
12          . . . . . . . . . . . .
```

```
; N=0115  0073H
x=12  y=12
01          . . . . . . . . . . . .
02          . . . . . . . . . . . .
03          . . . . . . . . . . . .
04          . . . . . . . . . . . .
05          . . . 0 . 0 . 0 . . . .
06          . . 0 . . . . . 0 . . .
07          . . . 0 . 0 . . . . . .
08          . . . . . . . 0 . . . .
09          . . 0 . . . . . 0 . . .
10          . . . 0 . 0 . 0 . . . .
11          . . . . . . . . . . . .
12          . . . . . . . . . . . .
```

FIG. 5c

```
; N=0116  0074H
x=12  y=12
01          . . . . . . . . . . . .
02          . . . . . . . . . . . .
03          . . . . . 0 . . . . . .
04          . . . . . 0 . . . . . .
05          . . 0 . 0 . 0 . 0 . . .
06          . . . . . 0 . . . . . .
07          . . . . . 0 . . . . . .
08          . . . . . 0 . . . . . .
09          . . . . . 0 . . . . . .
10          . . . . . . 0 . 0 . . .
11          . . . . . . . . . . . .
12          . . . . . . . . . . . .
```

```
; N=0118  0076H
x=12  y=12
01          . . . . . . . . . . . .
02          . . . . . . . . . . . .
03          . . . . . . . . . . . .
04          . . . . . . . . . . . .
05          . 0 . . . . . . . 0 . .
06          . 0 . . . . . . . 0 . .
07          . . 0 . . . . . 0 . . .
08          . . . 0 . . . 0 . . . .
09          . . . . 0 . 0 . . . . .
10          . . . . . 0 . . . . . .
11          . . . . . . . . . . . .
12          . . . . . . . . . . . .
```

```
; N=0117  0075H
x=12  y=12
01          . . . . . . . . . . . .
02          . . . . . . . . . . . .
03          . . . . . . . . . . . .
04          . . . . . . . . . . . .
05          . . 0 . . . . . . 0 . .
06          . . 0 . . . . . . 0 . .
07          . . 0 . . . . . . 0 . .
08          . . 0 . . . . . . 0 . .
09          . . 0 . . . . . . 0 . .
10          . . . 0 . 0 . 0 . 0 . .
11          . . . . . . . . . . . .
12          . . . . . . . . . . . .
```

```
; N=0119  0077H
x=12  y=12
01          . . . . . . . . . . . .
02          . . . . . . . . . . . .
03          . . . . . . . . . . . .
04          . . . . . . . . . . . .
05          . 0 . . . . . . . 0 . .
06          . 0 . . . . . . . 0 . .
07          . 0 . . . . . . . 0 . .
08          . 0 . . . 0 . . . 0 . .
09          . . 0 . 0 . 0 . 0 . . .
10          . . . 0 . . . 0 . . . .
11          . . . . . . . . . . . .
12          . . . . . . . . . . . .
```

FIG. 5d

```
; N=0040 0028H
x=12 y=12
01  . . . . . . . . . . . .
02  . . . . . . . 0 . . . .
03  . . . . . 0 . . . . . .
04  . . . . . 0 . . . . . .
05  . . . . 0 . . . . . . .
06  . . . . 0 . . . . . . .
07  . . . . 0 . . . . . . .
08  . . . . 0 . . . . . . .
09  . . . . . 0 . . . . . .
10  . . . . . 0 . . . . . .
11  . . . . . . . 0 . . . .   126
12  . . . . . . . . . . . .
```

114

```
; N=0041 0029H
x=12 y=12
01  . . . . . . . . . . . .
02  . . . . 0 . . . . . . .
03  . . . . . . 0 . . . . .
04  . . . . . . 0 . . . . .
05  . . . . . . . 0 . . . .
06  . . . . . . . 0 . . . .
07  . . . . . . . 0 . . . .
08  . . . . . . . 0 . . . .
09  . . . . . . 0 . . . . .
10  . . . . . . 0 . . . . .
11  . . . . 0 . . . . . . .   126
12  . . . . . . . . . . . .
```

116

```
; N=0042 002AHH
x=12 y=12
01  . . . . . . . . . . . .
02  . . . . . 0 . . . . . .
03  . . . . . 0 . . . . . .
04  . 0 . 0 . 0 . 0 . . . .
05  . . . . 0 . 0 . . . . .
06  . . 0 . . . . . 0 . . .
07  . . . . . . . . . . . .
08  . . . . . . . . . . . .
09  . . . . . . . . . . . .
10  . . . . . . . . . . . .
11  . . . . . . . . . . . .
12  . . . . . . . . . . . .
```

```
; N=0043 002BH
x=12 y=12
01  . . . . . . . . . . . .
02  . . . . . . . . . . . .
03  . . . . . . . . . . . .
04  . . . . . . . . . . . .
05  . . . . . 0 . . . . . .
06  . . . . . 0 . . . . . .
07  . 0 . 0 . 0 . 0 . . . .
08  . . . . . 0 . . . . . .
09  . . . . . 0 . . . . . .
10  . . . . . . . . . . . .
11  . . . . . . . . . . . .
12  . . . . . . . . . . . .
```

```
; N=0044 002CH
x=12 y=12
01  . . . . . . . . . . . .
02  . . . . . . . . . . . .
03  . . . . . . . . . . . .
04  . . . . . . . . . . . .
05  . . . . . . . . . . . .
06  . . . . . . . . . . . .
07  . . . . . . . . . . . .
08  . . . . . . . . . . . .
09  . . . . 0 . 0 . . . . .
10  . . . . . 0 . . . . . .
11  . . . . 0 . . . . . . .   126
12  . . . . . . . . . . . .
```

```
; N=0045 002DH
x=12 y=12
01  . . . . . . . . . . . .
02  . . . . . . . . . . . .
03  . . . . . . . . . . . .
04  . . . . . . . . . . . .
05  . . . . . . . . . . . .
06  . . 0 . 0 . 0 . 0 . . .
07  . . . . . . . . . . . .
08  . . . . . . . . . . . .
09  . . . . . . . . . . . .
10  . . . . . . . . . . . .
11  . . . . . . . . . . . .
12  . . . . . . . . . . . .
```

FIG. 6a

```
; N=0045 002EH
x=12 y=12
01  . . . . . . . . . . . .
02  . . . . . . . . . . . .
03  . . . . . . . . . . . .
04  . . . . . . . . . . . .
05  . . . . . . . . . . . .
06  . . . . . . . . . . . .
07  . . . . . . . . . . . .
08  . . . . . . . . . . . .
09  . . . . 0 . 0 . . . . .
10  . . . . 0 . 0 . . . . .
11  . . . . . . . . . . . .
12  . . . . . . . . . . . .
```

112

```
; N=0046 002FH
x=12 y=12
01  . . . . . . . . . . . .
02  . . . . . . . . . 0 . .
03  . . . . . . . . 0 . . .
04  . . . . . . . 0 . . . .
05  . . . . . . 0 . . . . .
06  . . . . . 0 . . . . . .
07  . . . . 0 . . . . . . .
08  . . . 0 . . . . . . . .
09  . . 0 . . . . . . . . .
10  . 0 . . . . . . . . . .
11  . . . . . . . . . . . .
12  . . . . . . . . . . . .
```

110

```
; N=0047 0030H
x=12 y=12
01  . . . . . . . . . . . .
02  . . . . 0 . 0 . . . . .
03  . . 0 . . . . . 0 . . .
04  . 0 . . . . . 0 . 0 . .
05  . 0 . . . . 0 . . 0 . .
06  . 0 . . . 0 . . . 0 . .
07  . 0 . . 0 . . . . 0 . .
08  . 0 . 0 . . . . . 0 . .
09  . . 0 . . . . . 0 . . .
10  . . . . 0 . 0 . . . . .
11  . . . . . . . . . . . .
12  . . . . . . . . . . . .
```

```
; N=0048 0031H
x=12 y=12
01  . . . . . . . . . . . .
02  . . . 0 . 0 . . . . . .
03  . . . . . 0 . . . . . .
04  . . . . . 0 . . . . . .
05  . . . . . 0 . . . . . .
06  . . . . . 0 . . . . . .
07  . . . . . 0 . . . . . .
08  . . . . . 0 . . . . . .
09  . . . . . 0 . . . . . .
10  . . . 0 . 0 . 0 . . . .
11  . . . . . . . . . . . .
12  . . . . . . . . . . . .
```

```
; N=0049 0032H
x=12 y=12
01  . . . . . . . . . . . .
02  . . . 0 . 0 . 0 . . . .
03  . 0 . . . . . . . 0 . .
04  . . . . . . . . . 0 . .
05  . . . . . . . . 0 . . .
06  . . . . . . 0 . . . . .
07  . . . . 0 . . . . . . .
08  . . 0 . . . . . . . . .
09  . 0 . . . . . . . . . .
10  . 0 . 0 . 0 . 0 . 0 . .
11  . . . . . . . . . . . .
12  . . . . . . . . . . . .
```

```
; N=0050 0033H
x=12 y=12
01  . . . . . . . . . . . .
02  . . . 0 . 0 . 0 . . . .
03  . 0 . . . . . . . 0 . .
04  . . . . . . . . . 0 . .
05  . . . . . . . . . 0 . .
06  . . . . . 0 . 0 . . . .
07  . . . . . . . . . 0 . .
08  . . . . . . . . . 0 . .
09  . 0 . . . . . . . 0 . .
10  . . 0 . 0 . 0 . 0 . . .
11  . . . . . . . . . . . .
12  . . . . . . . . . . . .
```

FIG. 6b

```
; N=0052 0034H
x=12 y=12
01  . . . . . . . . . . . .
02  . . . 0 . 0 . 0 . . . .
03  . . . 0 . . . 0 . . . .
04  . . 0 . . . . 0 . . . .
05  . . 0 . . . . 0 . . . .
06  . 0 . . . . . 0 . . . .
07  . 0 . 0 . 0 . 0 . 0 . .
08  . . . . . . . 0 . . . .
09  . . . . . . . 0 . . . .
10  . . . . . . . 0 . . . .
11  . . . . . . . . . . . .
12  . . . . . . . . . . . .
```

```
; N=0054 0036H
x=12 y=12
01  . . . . . . . . . . . .
02  . . . 0 . 0 . 0 . . . .
03  . 0 . . . . . . . . . .
04  . 0 . . . . . . . . . .
05  . 0 . . . . . . . . . .
06  . 0 . 0 . 0 . 0 . . . .
07  . 0 . . . . . . . 0 . .
08  . 0 . . . . . . . 0 . .
09  . 0 . . . . . . . 0 . .
10  . . 0 . 0 . 0 . 0 . . .
11  . . . . . . . . . . . .
12  . . . . . . . . . . . .
```

```
; N=0053 0035H
x=12 y=12
01  . . . . . . . . . . . .
02  . 0 . 0 . 0 . 0 . 0 . .
03  . 0 . . . . . . . . . .
04  . 0 . . . . . . . . . .
05  . 0 . . . . . . . . . .
06  . 0 . 0 . 0 . 0 . . . .
07  . . . . . . . . . 0 . .
08  . . . . . . . . . 0 . .
09  . 0 . . . . . . . 0 . .
10  . . 0 . 0 . 0 . 0 . . .
11  . . . . . . . . . . . .
12  . . . . . . . . . . . .
```

```
; N=0055 0037H
x=12 y=12
01  . . . . . . . . . . . .
02  . 0 . 0 . 0 . 0 . 0 . .
03  . 0 . . . . . . 0 . . .
04  . . . . . . . 0 . . . .
05  . . . . . . 0 . . . . .
06  . . . . . 0 . . . . . .
07  . . . . 0 . . . . . . .
08  . . . 0 . . . . . . . .
09  . . 0 . . . . . . . . .
10  . 0 . . . . . . . . . .
11  . . . . . . . . . . . .
12  . . . . . . . . . . . .
```

FIG. 6c

```
; N=0056 0038H
x=12 y=12
01          . . . . . . . . . . . .
02          . . . 0 . 0 . 0 . . . .
03          . 0 . . . . . . . 0 . .
04          . 0 . . . . . . . 0 . .
05          . 0 . . . . . . . 0 . .
06          . . 0 . 0 . 0 . 0 . . .
07          . 0 . . . . . . . 0 . .
08          . 0 . . . . . . . 0 . .
09          . 0 . . . . . . . 0 . .
10          . . 0 . 0 . 0 . 0 . . .
11          . . . . . . . . . . . .
12          . . . . . . . . . . . .
```

```
; N=0058 003AH
x=12 y=12
01          . . . . . . . . . . . .
02          . . . . . . . . . . . .
03          . . . . . . . . . . . .
04          . . . . 0 . 0 . . . . .
05          . . . . 0 . 0 . . . . .
06          . . . . . . . . . . . .
07          . . . . . . . . . . . .
08          . . . . . . . . . . . .
09          . . . . 0 . 0 . . . . .
10          . . . . 0 . 0 . . . . .
11          . . . . . . . . . . . .
12          . . . . . . . . . . . .
```

```
; N=0057 0039H
x=12 y=12
01          . . . . . . . . . . . .
02          . . . 0 . 0 . 0 . . . .
03          . 0 . . . . . . . 0 . .
04          . 0 . . . . . . . 0 . .
05          . 0 . . . . . . . 0 . .
06          . . . 0 . 0 . 0 . 0 . .
07          . . . . . . . . . 0 . .
08          . . . . . . . . . 0 . .
09          . . . . . . . . . 0 . .
10          . . 0 . 0 . 0 . 0 . . .
11          . . . . . . . . . . . .
12          . . . . . . . . . . . .
```

```
; N=0059 003BH
x=12 y=12
01          . . . . . . . . . . . .
02          . . . . . . . . . . . .
03          . . . . . . . . . . . .
04          . . . . 0 . 0 . . . . .
05          . . . . 0 . 0 . . . . .
06          . . . . . . . . . . . .
07          . . . . . . . . . . . .
08          . . . . . . . . . . . .
09          . . . . 0 . 0 . . . . .
10          . . . . . 0 . . . . . .   126
11          . . . . 0 . . . . . . .
12          . . . . . . . . . . . .
```

FIG. 6d

INKJET PRINTING SYSTEM WITH INK-EFFICIENT FONT

BACKGROUND OF THE INVENTION

Impact printers have traditionally been used to create point-of-sale (POS) receipts in the form of a hardcopy printout for the purchaser. Such receipts typically list the item description and price for each purchase in order to create a subtotal, with any sales tax or discount also tabulated in order to create a final total cost. Additional date, location, store name, and promotional messages are usually also shown on the receipt, as well as the details of payment such as cash tendered, credit card type and account number, etc.

The goal is to display all of the above-identified information legibly on a small size piece of plain paper which is printed in an efficient, reliable and inexpensive manner. Impact printers often do not consistently produce legible receipts, and in many instances are rather noisy. Accordingly there is a need to adapt inkjet printing technology for use in creating POS receipts without having to use an excessive amount of ink.

BRIEF SUMMARY OF THE INVENTION

An ink-efficient format for a customized font in a printing system for printing alphanumeric data and symbols. The customized font can be implemented using a relatively low resolution printhead for creating digitized characters in precise pixel grid locations on media such as a hardcopy receipt. Each character is formed in a block of predetermined size called herein a hybrid cell having a central printable portion and certain non-printable perimeter portions. A preferred hybrid cell incorporates a pixel grid having a higher resolution in a printing scan direction along an X axis as compared to a so-called standard resolution in a media advance direction along a Y axis. In one exemplary form the X axis dot-per-inch (dpi) resolution between columns is twice the dpi resolution of the Y axis resolution between rows.

In a preferred form a swath width defined by a nozzle array on a print cartridge enables an entire full height of a sequence of digital characters to be printed in a single pass of the print cartridge over a row of hybrid cells. For higher throughput, some embodiments employ bidirectional printing, while other embodiments provide lengthened nozzle arrays in order to print multiple rows of characters in a single pass of printhead(s) across the media. By providing each row of hybrid cells with a spaced apart resolution matching the nozzle pitch of the nozzle array, each row of the printable portion of the hybrid cell can be available for receiving marking dots during a single pass of the print cartridge.

If desirable a customized font may include a family of differently sized hybrid cells in order to provide prominence to certain items include in a printout. Also in some printing systems incorporating the customized fonts of the present invention, multiple printheads in one or more print cartridges can be respectively supplied with different color inks in order to distinguish between certain items in a printout. In other embodiments featuring more prominent displays of certain items, double and/or triple sequences of parallel lines can be used to form certain digitized characters of the font.

A fast print mode allows a minimal amount of ink to be deposited on relatively few pixels in each hybrid cell without unduly detracting from the legibility of the printed characters. In one aspect of the invention, such a print mode prevents marking drops from being deposited on adjacent pixels in a given row. Thus a solid appearing line or a partial area fill will have marking drops only on alternate pixels in a given row. However by changing the timing patterns on adjacent rows it is possible to achieve high legibility for diagonal and curved shapes without having to increase the firing frequency of the nozzles or other marking elements. The resulting digitized characters can therefore be constructed with various combinations of straight, slanted and curved lines without using an excessive amount of ink. In a preferred embodiment each individual line forming various upper and lower case alphanumeric characters is defined by a single sequence of marking dots.

The preferred external dimensions for a hybrid cell are defined to provide a shortened width dimension measured along the X axis. Thus the cell width is a fractional portion of the cell height measured along the Y axis. In one currently preferred embodiment the cell width is one-half of the cell height. Thus in an exemplary printing system using a print cartridge having 12 nozzles with a 96 dpi nozzle pitch which prints on a 96×192 pixel grid (i.e., 96 dpi in the Y axis direction and 192 dpi in the X axis direction), the height dimension of the hybrid cell would be 12 pixels high while the width dimension of the hybrid cell would also be 12 pixels wide.

Printable pixel areas are chosen to assure adequate spacing between characters on adjacent rows as well as adjacent columns. As a result a single print swath by one or more printheads across the receipt will create a single linear collection of characters, with all of the numeric monetary numerals and symbols precisely positioned both vertically and horizontally for easy visual perusal of the individual prices as well as the computed totals.

Where it is deemed necessary and desirable, differently sized cells can be incorporated into the same font in order to display some information more prominently than others. Also in order to provide such more prominent display, double and/or triple sequences of parallel lines can be used to form the various digitized characters of the font.

The invention therefore provides a high throughput printing system which may use low resolution printheads to create legible printouts of rasterized data using a hybrid font whyerein each digitized character can be formed by a minimal number of ink drops.

BRIEF DESCRIPTION OF DRAWINGS

FIG. 4 shows some exemplary bitmaps for the customized font of the present invention, including certain symbols and all capital (caps) letter characters.

FIG. 5 shows some additional exemplary bitmaps for the customized font of the present invention, including certain lower case letter characters.

FIG. 6 shows additional exemplary bitmaps for the customized font of the present invention, including certain symbols and numerical characters.

DETAILED DESCRIPTION OF EXEMPLARY EMBODIMENTS

Figure 1:
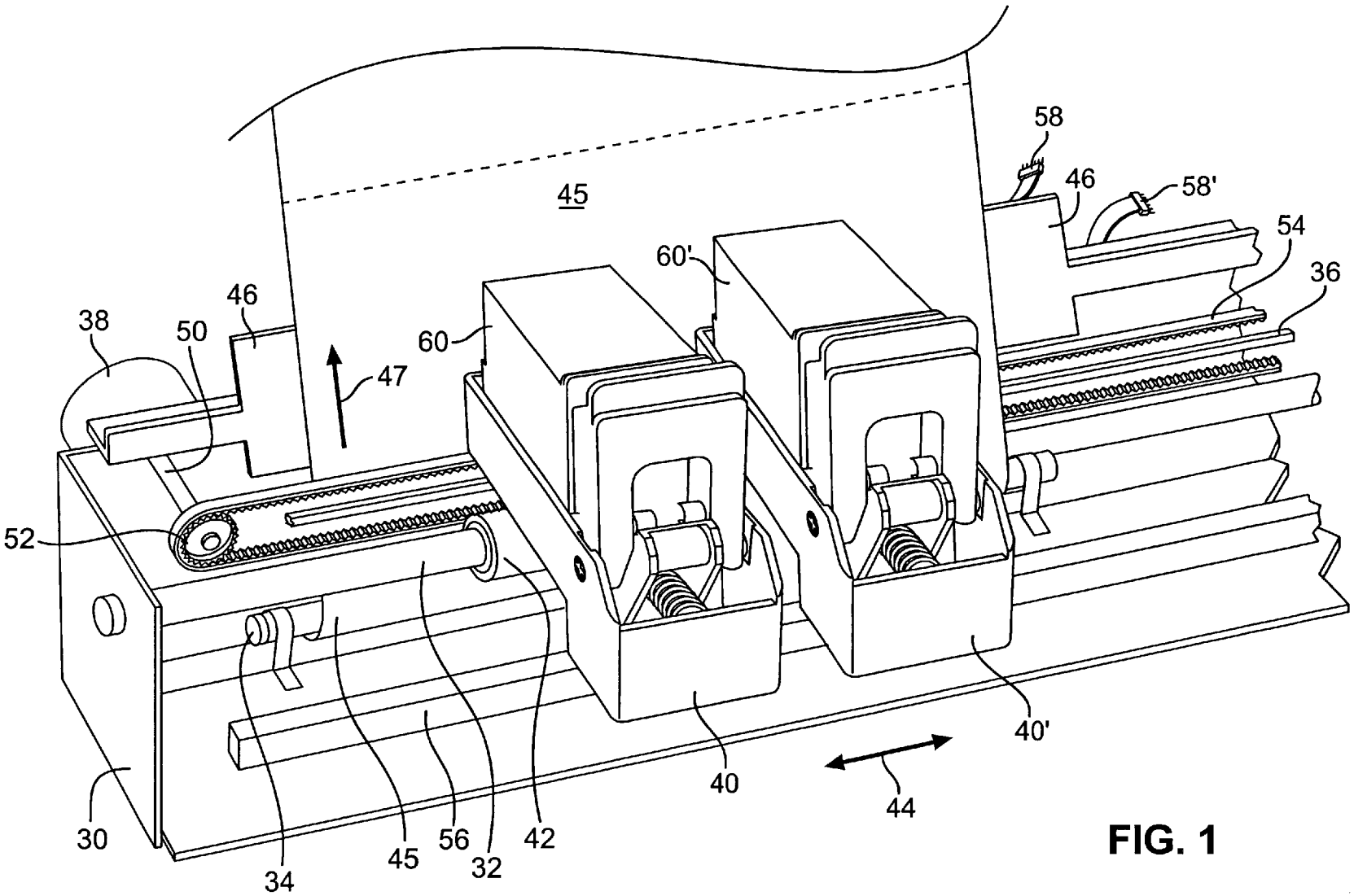
FIG. 1 shows an inkjet printing system which may incorporate the features of the present invention.

An exemplary printing mechanism as shown in FIG. 1 includes a frame 30, carnage support bar 32, media guide bar 34, encoder strip 36, and carriage drive motor 38. A carriage member 40 may include a cylindrical bushing 42 which rides on the support bar 32 back and forth in a carriage scan direction 44 while a sheet of print media 45 is periodically advanced over a platen 46 in a media advance direction 47 through a print zone. The carriage drive motor 38 is typically mounted on a back of the frame 30 and rotates on an axle 50 which carries a belt gear 52 which engages an inside toothed surface of a carriage drive belt 54. The left end of the encoder strip is cut away to show details of the carriage drive mechanism. In order to facilitate proper positioning of the carriage over the print zone, a guide bracket (not shown) may be attached at the bottom front of the carriage 40 to slide along a guide bar 56. Of course, the unique carriage features described in more detail below can be utilized with any type of drive mechanism and support bar bearings as may be appropriate for the intended use of the printer.

In its simplest form, the invention can be implemented with a single print cartridge 60 mounted in carriage 40 and connected through a flex circuit 58 to an printer control unit such as a computer, sales register, etc. However for greater efficiency and throughput, the invention contemplates additional print cartridges such as 60' with flex circuit 58' and mounted in their own carriage 40' which could be aligned with cartridge 40 for both passing over a same swath or alternatively be located in staggered relationship to print a double swath in a single pass. Although the features of the present invention are especially applicable for use with monochrome printheads, a person skilled in the art could implement the present invention with separate printheads each having a different color marking liquid, or even with tri-compartment print cartridges having three different types or different color liquids.

Also, although a preferred orientation of the printer carriage and print cartridge as shown in FIG. 1 currently provides a vertical platen with a nozzle plate ejecting marking liquid in an approximately horizontal direction onto the media, the unique carriage and cartridge system can also be used with print cartridges mounted over a horizontal platen having a nozzle plate ejecting marking liquid downwardly onto the media.

Figure 2:
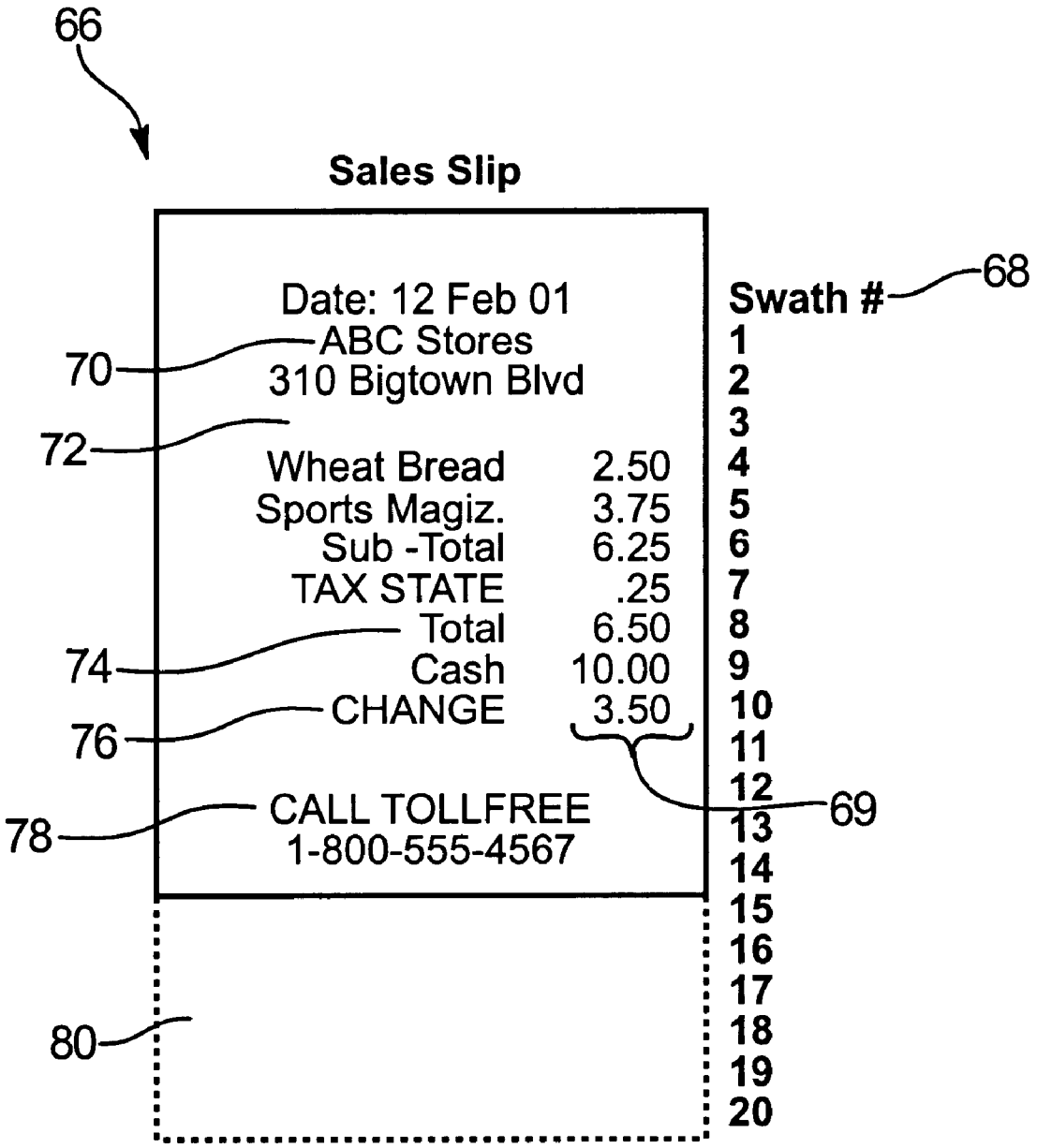
FIG. 2 shows an exemplary POS printout which can be printed with a printing system and font of the present invention.

An exemplary POS receipt 66 is shown in FIG. 2 incorporating the invention. Such a receipt may have a very basic format wherein each swath 68 corresponds to a respective row of characters, and wherein all the numerical characters are in aligned vertical columns 69. Alternatively such a receipt may include additional enhancements such as for example an all-caps row 70 for identifying the name of the store, one or more unprinted rows 72, different color all-caps markings for a "TOTAL" row 74 and a "CHANGE" row 76, and enlarged size character cells for all-caps notifications 78 Also the media can be in traditional sheet or roll form to provide adequate length 80 for listing many additional items.

Figure 3:
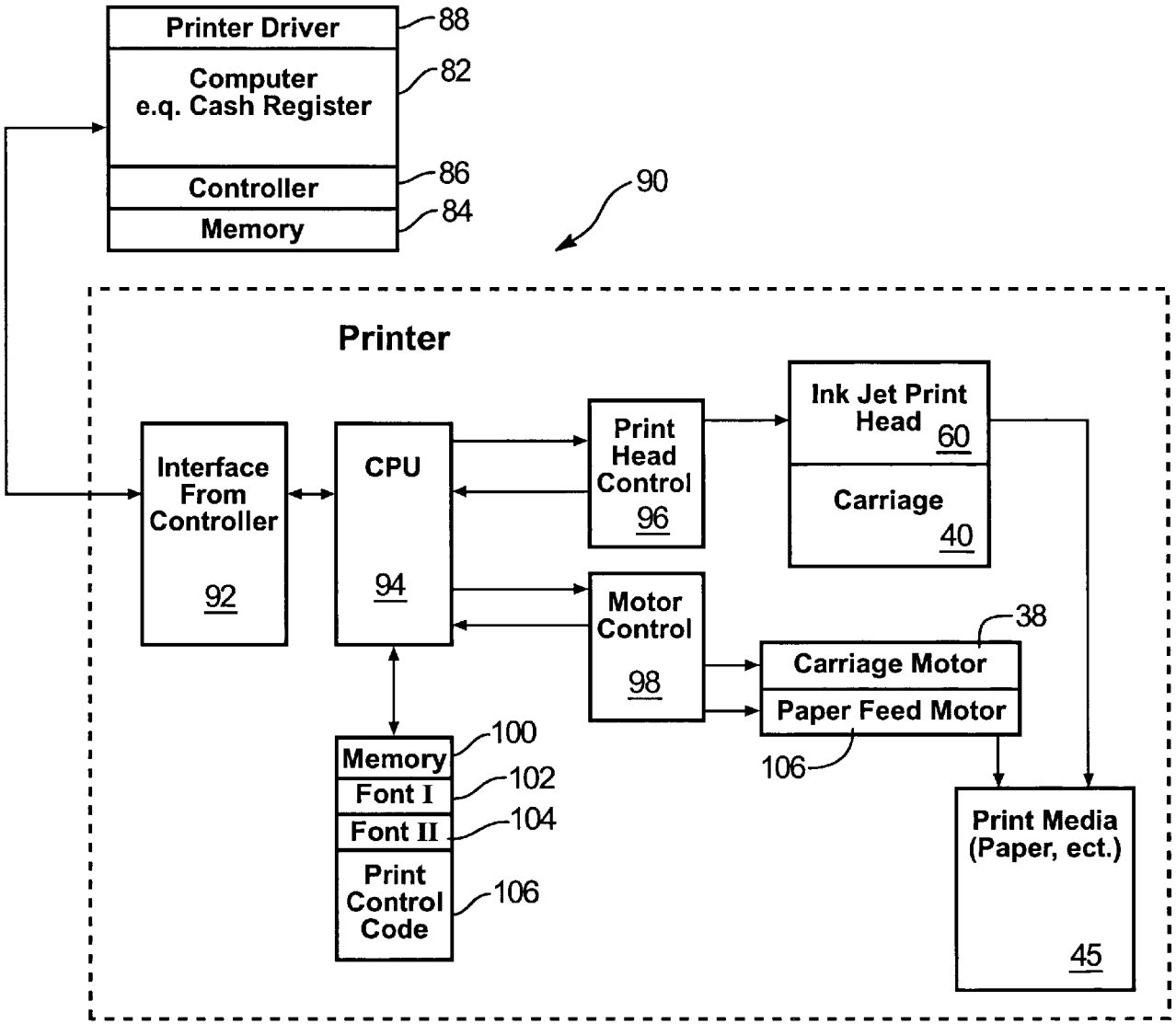
FIG. 3 is a block diagram showing the invention implemented in a computer/printer system.

The block diagram of FIG. 3 illustrates the various printer components which are utilized in practicing the present invention. A computer 82 such as a desk top cash register, hand-held digital appliance, or the like is typically used by a sale clerk to input data into internal or external memory 84. A controller 86 uses a printer driver 88 to transfer the data to a printer 90 through its I/O interface 92. A printer CPU 94 is connected to the I/O interface and communicates with printhead control and motor control units 96, 98 as well as with printer memory 100 which may store separate fonts 102, 104 as well as print control codes 106.

The carriage motor 38 moves the carriage 40 and its attached printhead(s) 60 back and forth across the media 45 in coordination with the periodic advancement of the media by a paper feed motor 106. It will be understood that relative movement of the media past a stationary carriage during printing will also enable the advantages of the invention to be realized without departing from the spirit and scope of the invention. Also the computer could be integrated into the printer and is shown as a separate unit for illustration only. Additionally the fonts may be stored to be accessible in various locations (see FIG. 10), and are shown to be stored in the printer memory by way of example only.

The exemplary bit maps shown on FIGS. 4–6 illustrate the various techniques used for displaying digitized characters using a single row of marking dots within a central printable portion of the pixel grid. The exemplary hybrid cells are by way of example only and show a hybrid character cell having a 12 by 12 matrix where the resolution along a horizontal X axis 110 is twice the dpi as the resolution along a vertical Y axis 112. Each bit map is identified by either a decimal #114 or alternatively a hexadecimal #116 or by any other suitable identification code. For the all-caps letters shown, the following perimeter pixels are not available for printing in order to provide adequate spacing between characters on adjacent columns and rows: bottom two rows 118; left edge column 120, right edge two columns 122 and top row 124 Other non-printable boundary definitions can be implemented so long as adequate inter-character spacing is provided for legibility based on the size, style, color and the like of the printout. It will be understood by those skilled in the art that certain symbols such as 126 and certain lower case letters such as 128 extend into these otherwise unprintable perimeter pixels to help distinguish such characters from other characters in the font, and without any significant impairment of overall legibility.

Figure 7:
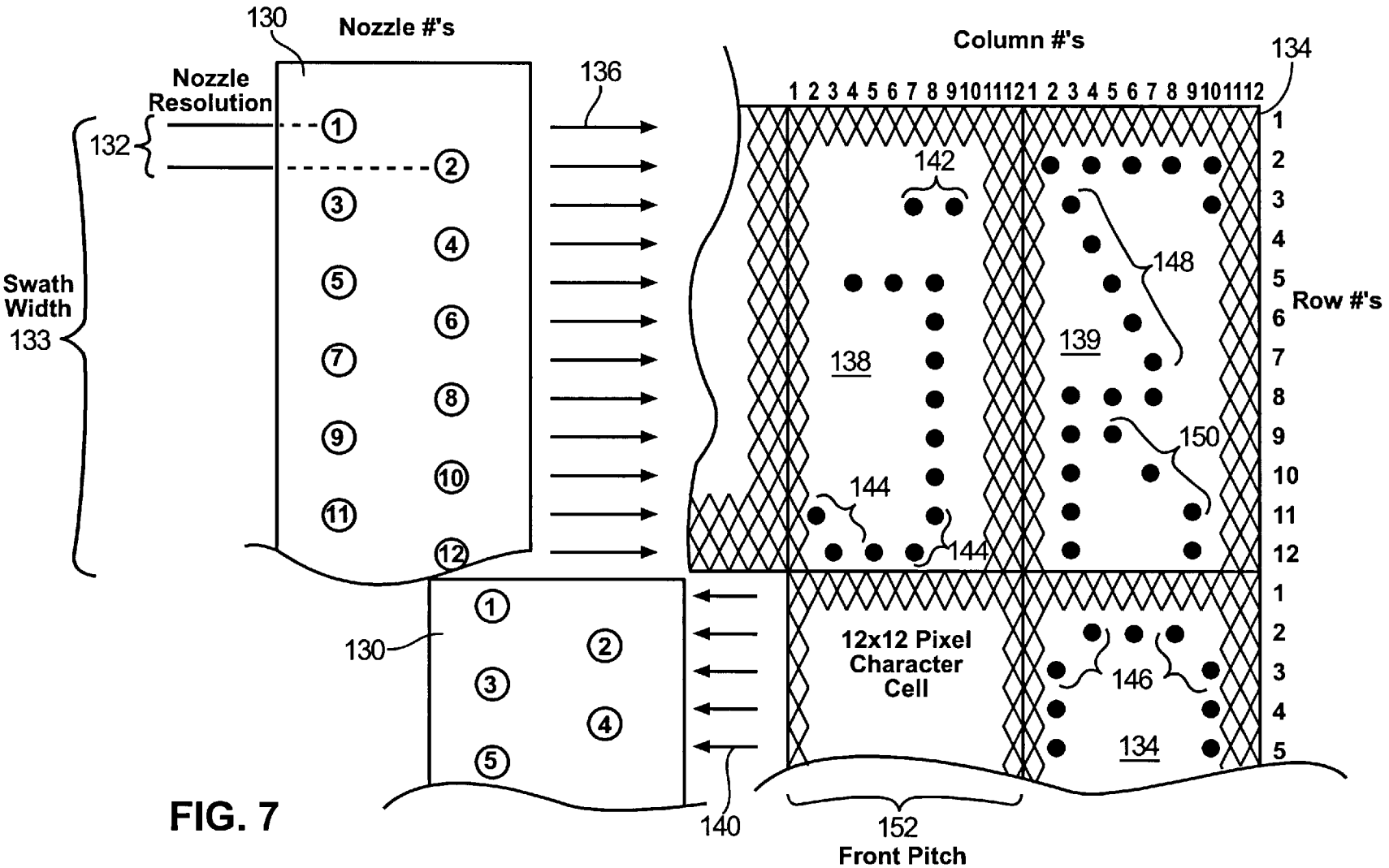
FIG. 7 is a schematic representation of one version of the invention having a single printhead applying marking dots on a row of hybrid cells in a forward pass over media, and applying marking dots on an adjacent row of hybrid cells in a reverse pass over media.

In the schematic illustration of FIG. 7, a single printhead 130 has twelve nozzles with a given nozzle pitch 132 which defines a swath width 133 that corresponds to the total number of rows in the exemplary character cells 134. The directional arrows 136 identify the forward printing direction for printing the lower case letter "j" shown in cell 138 and the arbitrary symbol shown in cell 139 in a single forward pass across the media. The directional arrows 140 identify the reverse printing direction for printing characters on the adjacent row in a single rearward pass across the media after the media has been advance a distance corresponding to the height of the character cells.

The exemplary characters in FIG. 7 illustrate some of the smoothing techniques which are possible with the unique pixel grid matrix of the present invention: a "dot" formed by a short horizontal line 142; two short "curves" 144; two longer "curves" 146, a "steep diagonal" line 148 formed by closely spaced marking dots; and an approximate 45 degree diagonal line 150 formed by less densely spaced marking dots. The normally non-printable perimeter pixel rows and columns previously described are marked with repeated XXXXs in FIG. 7. The font pitch 152 is shown as the entire width of a hybrid character cell including the non-printable columns.

Figure 8:
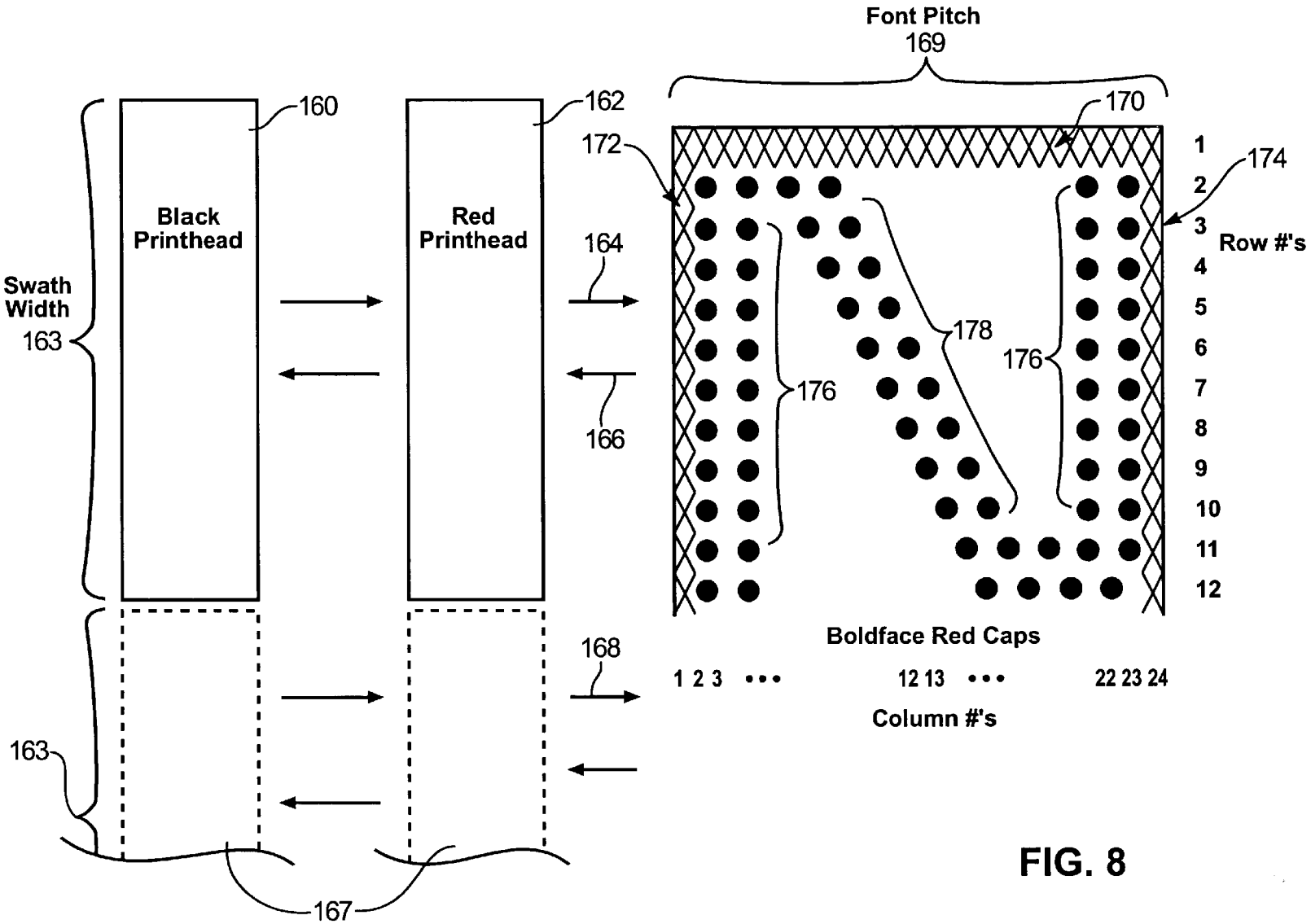
FIG. 8 is a schematic representation of another version of the invention having two aligned printheads each having different color ink applying boldface red marking dots on a row of double-width hybrid cells in a forward pass over media.

An alternative printing system employing the features of the invention is shown in FIG. 8, wherein a black ink printhead 160 and a red ink printhead 162 are aligned for printing over the same swath width 163 in a single forward pass shown by directional arrow 164. In this version there is no printing in the reverse pass shown by arrow 166. After advance of the media so that both printheads are in the positions 167 shown in phantom, the printheads then move forwardly in the direction shown by arrow 168 over an adjacent sequence of character cells. It will be appreciated that either black ink or red ink or both may if desired be applied to the various printable pixels in a single pass (forward or reverse) over a given sequence of character cells. The character cell shown has a double-width font pitch 169 with only the following unprintable perimeter pixels: a single top edge row 170; a single left edge column 172; and a single right edge column 174. In this example the bottom edge row is within the printable portion of the pixel. For prominence the enlarged capital letter "N" is printed with double parallel lines in both the vertical 176 and diagonal 178 directions.

Figure 9:
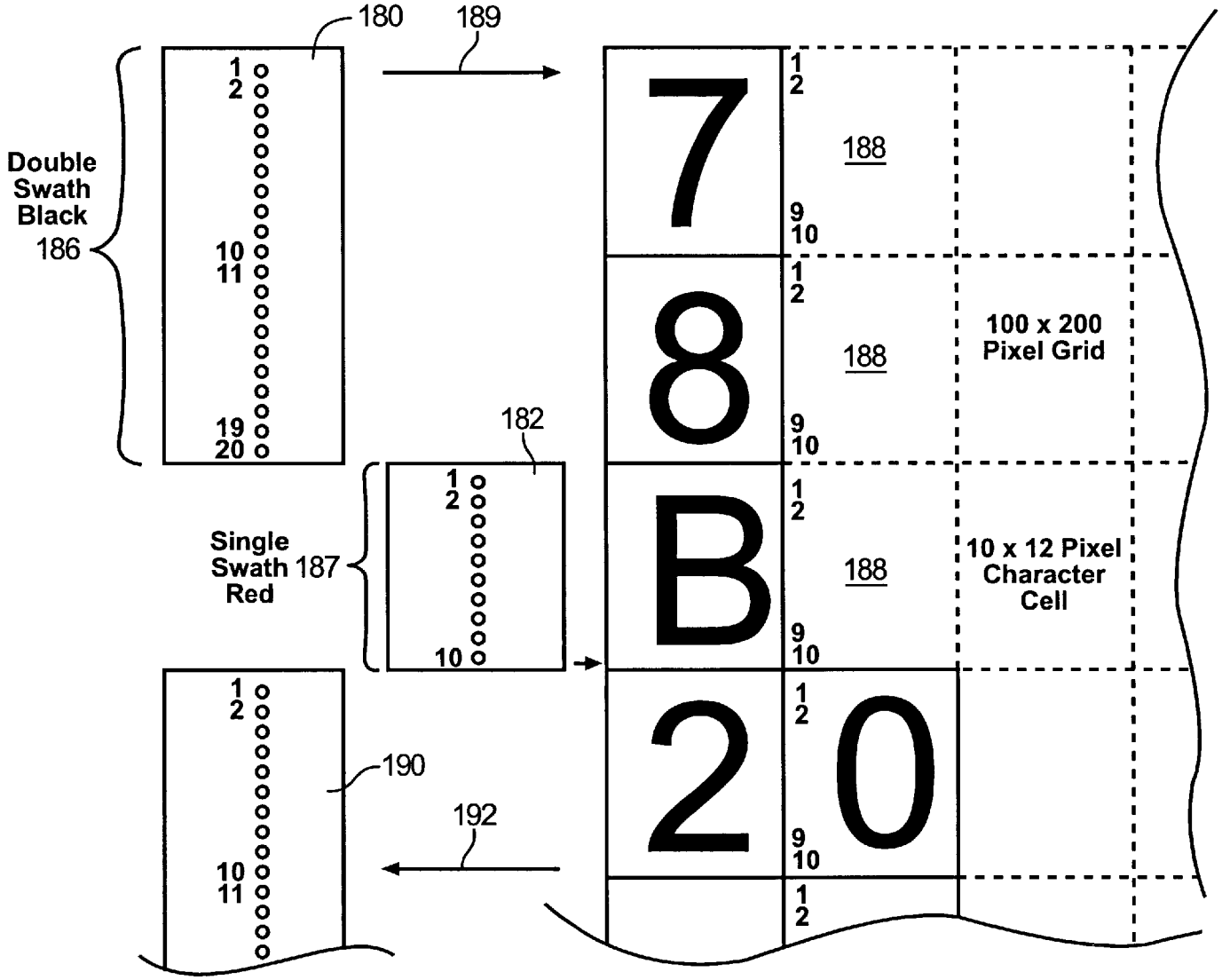
FIG. 9 is a schematic representation of yet another version of the invention having two staggered printheads each having different color ink applying dots on three rows of another embodiment of hybrid cells in a forward pass over media, and applying marking dots on an adjacent row during a return pass.

Still a different printing embodiment is shown in FIG. 9 wherein a black printhead 180 having 20 nozzles in a 100 dpi nozzle array is combined with a non-aligned staggered red printhead 182 having 10 nozzles in a 100 dpi nozzle array. Together these two printheads define a triple swath width swath formed by black swath width 186 and red swath width 187. These printheads pass in the forward direction 189 over hybrid pixel cells 188 formed by a 10 by 12 sized matrix on a 100 by 200 dpi pixel grid, and in the illustrated schematic have printed the numerals "7", "8" and the capital letter "B" on three separate swaths during a single pass.

By formatting a receipt which does not allow black and red marking dots on the same character cells, the media can be advance a full three swath distance so that the newly positioned black printhead shown at 190 have printed the numerals "2" and "0" while doing a reverse pass shown by arrow 192. Exceptional throughput using dual color bi-directional printing can thereby be achieved with this embodiment. Moreover, if one of the printheads is depleted of its ink supply, and a replacement is not readily available, a backup slow printmode can be used to provide monochrome printing by the remaining printhead.

Figure 10:
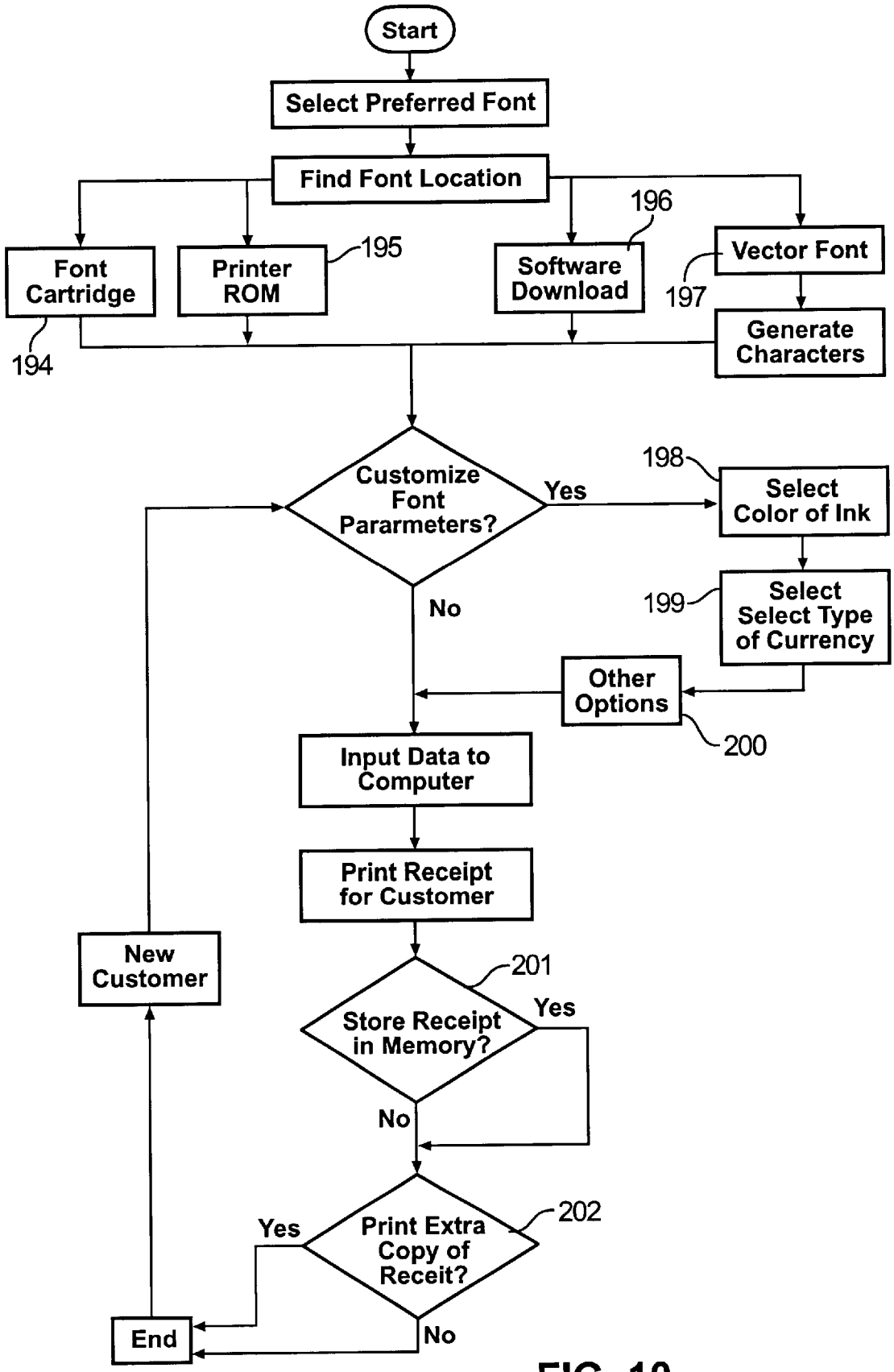
FIG. 10 is a schematic flow chart showing an exemplary method of practicing the invention using various types of font implementations in a printing system

An exemplary method of using the features of the present invention with a customized font stored in various storage media and using rasterized data as well as vector data is shown in the schematic flow chart of FIG. 10. Of course the invention is not limited to the font cartridge 194, printer ROM 195, soft font 196, or vector font 197 shown in the drawing, but can be applied to any type of internal or external storage device, whether stored in hardware, firmware or software, on the internet, in the printer, or anywhere else. Also the customized font of the present invention can be adapted for user-activated options such as ink color selection 198, type of domestic or foreign currency 199, other options such as foreign language selection, etc. 200 as well as different methods of keeping a record of the printed customer receipt 201, 202.

In the illustrated version where the font is stored in the printer memory, it is in a location sometimes called "Code Pages". For example code page 437 is set aside for the standard English Character set (the characters found on most keyboards in the United States.). Although the font code is often installed at the factory, soft fonts can also be installed in the printer memory when they are downloaded by the printer control firmware from a host computer, a network server or from a web site across the internet. It will therefore be understood that fonts can be retrieved from a variety of both internal and external sources. In a typical situation when the printer receives data from a controller, the printer locates the selected font, looks into an appropriate code page to find the bit map information for the appropriate characters, and then prints out each character using that set of marking dots forming the predetermined pattern defined by the bit map. Moreover when additional symbols become available to be added to a font (e.g. the new euro monetary symbol), most fonts have additional storage space for adding such new characters in a rasterized format that conforms to the font specifications.

It will be understood by those skilled in the art that various changes, improvements, and enhancements can be made without departing from the spirit and scope of the invention as set forth in the following claims.

We claim as our invention:

1. A memory device having a customized printing font stored therein, the font comprising a collection of characters each formed from a predetermined digitized mapping in a hybrid cell, said hybrid cell formed by a pixel grid with vertical columns spaced apart from each other along an X axis according to a first, X axis resolution and with horizontal rows spaced apart from each other along a Y axis according to a second, Y axis resolution, wherein said X axis resolution is a higher resolution than said Y axis resolution.

2. The font of claim 1 wherein said Y axis resolution is a fractional portion of said X axis resolution.

3. The font of claim 2 wherein said Y axis resolution is approximately one half of said X axis resolution.

4. The font of claim 1 wherein certain of said hybrid cells include a printable portion which does not incorporate at least one perimeter row of the cell.

5. The font of claim 1 wherein certain of said hybrid cells include a printable portion which does not incorporate at least one perimeter column of the cell.

6. The font of claim 5 wherein certain of said hybrid cells include the printable portion which does not incorporate at least one perimeter row of the cell.

7. The font of claim 1 wherein a group of the digitized characters is formed by a single linear sequence of marking dots at least partially arranged in straight lines.

8. The font of claim 7 wherein certain digitized characters are formed by a single linear sequence of marking dots arranged in straight lines oriented vertically, horizontally and diagonally.

9. The font of claim 1 wherein certain of said hybrid cells include a printable portion wherein marking dots are not located on adjacent pixels in a given horizontal row.

10. The font of claim 1 wherein said hybrid cell has a horizontal dimension less than its vertical dimension.

11. The font of claim 10 wherein said hybrid cell has a horizontal dimension which is approximately one half the vertical dimension.

12. The font of claim 10 wherein said hybrid cell is formed by a pixel grid having the same number of pixels in the X axis and the Y axis.

13. The font of claim 1 wherein said Y axis resolution is less than 300 dpi.

14. The font of claim 1 wherein said X axis resolution is less than 300 dpi.

15. The font of claim 14 wherein said X axis resolution is less than 200 dpi.

16. A printing system having a customized font, comprising:

a) a print cartridge having marking elements;

b) a memory device coupled to said print cartridge, and storing the customized font, wherein the customized font comprises a plurality of characters each defined within a hybrid character cell, each cell containing a pixel grid with vertical columns of spaced apart pixels with a first vertical resolution, and horizontal rows of spaced apart pixels with a second horizontal resolution, wherein the second horizontal resolution has a higher pixel density than the first vertical resolution; and c) a carriage for holding the print cartridge over printing media to allow the print cartridge to apply making dots to form said characters according to said customized font.

17. The printing system of claim 16 wherein said customized font includes fixed pitch character cells having at least one edge row and one edge column excluded from printing, and wherein printing is not allowed on adjacent pixels in a single row.

18. A method of printing a row of characters in fixed pitch character cells comprising selecting a font defined by bit maps wherein each bit map is formed by a pixel grid having a higher first resolution along a carriage scan axis as compared to a second resolution along a media advance axis, with each character cell having a shorter first dimension along the carriage scan axis as compared to a second dimension along the media advance axis;

providing a printhead having a nozzle pitch which is substantially the same as the second resolution; and printing at least one complete swath of character cells in a single pass of the printhead across a print media.

19. The method of claim 18, which further includes providing a plurality of printheads each having the same nozzle pitch, wherein said printing includes printing at least one different complete swath of character cells in a reverse single pass of the printheads across the print media.

20. The method of claim 18, which further includes selecting a font defined by bit maps having certain perimeter rows and columns which are not printable, including at least two non-printable columns and at least one non-printable row.

21. The method of claim 18, which further includes selecting a font defined by bit maps having printable rows, wherein marking dots are not allowed to be printed on adjacent pixels in any given individual row.

22. The method of claim 18, which further includes selecting a font defined by bit maps to form character cells which have an X axis dimension which is approximately one half of the Y axis dimension.

23. The method of claim 18, which further includes selecting a font defined by bit maps having a print resolution along the X axis which is approximately twice the print resolution along the Y axis.

24. The font of claim 13 wherein said Y axis resolution is less than 100 dpi.

25. A system for printing a row of characters in fixed pitch character cells comprising:

means for defining a font wherein each character of said font is defined in a hybrid cell comprising a pixel grid, wherein said pixel grid has a higher first resolution along a carriage scan axis as compared to a second resolution along a media advance axis;

means for selectively printing characters of said font on a print medium.

26. The system of claim 25, wherein said means for selectively printing comprise at least one printhead configured to print at least one swatch of character cells in a single pass across the print medium.

27. The system of claim 26, wherein said means for selectively printing comprise a plurality of printheads each having a same nozzle pitch configured to print at least one different complete swath of character cells in a reverse single pass of the printheads across the print medium.

28. The system of claim 25, wherein said means for defining a font further comprise means for designating certain perimeter pixel rows and columns of said hybrid cell that are not printable.

29. The system of claim 25, wherein said hybrid cell has a vertical dimension greater than a horizontal dimension.

* * * * *